US008041239B2

(12) United States Patent
Nagata

(10) Patent No.: US 8,041,239 B2
(45) Date of Patent: Oct. 18, 2011

(54) IMAGE FORMING APPARATUS CONTROLLING THE RECYCLING OF TONER BASED ON PAPER QUALITY

(75) Inventor: Kenichi Nagata, Shiki-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 1341 days.

(21) Appl. No.: 11/593,510

(22) Filed: Nov. 7, 2006

(65) Prior Publication Data

US 2007/0104500 A1 May 10, 2007

(30) Foreign Application Priority Data

Nov. 7, 2005 (JP) ..... 2005-322544

(51) Int. Cl.
*G03G 15/00* (2006.01)

(52) U.S. Cl. ..... 399/45; 399/359

(58) Field of Classification Search ..... 399/45, 399/359

See application file for complete search history.

(56) References Cited

U.S. PATENT DOCUMENTS

| | | | | |
|---|---|---|---|---|
| 5,481,351 | A | 1/1996 | Kawai et al. | |
| 6,192,212 | B1 * | 2/2001 | Kunihiro et al. | 399/253 |

FOREIGN PATENT DOCUMENTS

| | | |
|---|---|---|
| JP | H01-144067 | 6/1989 |
| JP | 03-011369 | 1/1991 |
| JP | 05-241489 | 9/1993 |
| JP | 6-308828 | 11/1994 |
| JP | 08-063067 | 3/1996 |
| JP | 09-080858 | 3/1997 |
| JP | H09-062080 | 3/1997 |
| JP | H09-236978 | 9/1997 |
| JP | H10-105015 | 4/1998 |
| JP | 10-214011 | 8/1998 |
| JP | 2000-267365 | 9/2000 |
| JP | 2000-335762 | 12/2000 |
| JP | 2002-004748 | 1/2002 |
| JP | 2002-189335 | 7/2002 |
| JP | 2002-311669 | 10/2002 |
| JP | 2003-149899 | 5/2003 |
| JP | 2005-3783 | 1/2005 |

* cited by examiner

*Primary Examiner* — David Porta
*Assistant Examiner* — Bryan Ready
(74) *Attorney, Agent, or Firm* — Nixon & Vanderhye, PC

(57) ABSTRACT

An image forming apparatus of the present invention includes an image supporting body, a developing device, a cleaning device, an input device, a recycling mechanism, and a controller. The image supporting body is for having a latent image based on image data formed on a surface thereof. The developing device applies a developer to the image supporting body to develop the latent image. The cleaning device eliminates developer remaining on the surface of the image supporting body, after a developer image formed by the developing has been transferred to paper. The input device receives a setting input related to a type of paper for use in image forming. The recycling mechanism transports the developer eliminated by the cleaning device to the developing device as recycled developer. The controller is configured to selectively operate the recycling mechanism based on the type of paper set by the input device.

9 Claims, 9 Drawing Sheets

PRIOR ART

FIG.6

| TYPE OF TRANSFER MATERIAL | EVALUATION OF IMAGE CHARASTERISTICS | | EVALUATION RESULT |
|---|---|---|---|
| | NUMBER OF UNDESIRED DOTS ON PAPER | IMAGE DENSITY | |
| HIGH QUALITY PAPER ONLY | ◎ | × | SUITABLE |
| RECYCLED PAPER ONLY | × | × | UNSUITABLE |

(◎ : EXCELLENT、○ : GOOD、△ : AVERAGE、× : POOR)

FIG.7

| SUPPLY RATIO OF RECYCLED TONER | IMAGE DESTINY | | | EVALUATION RESULT |
|---|---|---|---|---|
| | 10K | 15K | 20K | |
| 30% | ◎ | ○ | × | UNSUITABLE |
| 25% | ◎ | ○ | △ | SUITABLE |
| 20% | ◎ | ◎ | ○ | SUITABLE |

(◎ : EXCELLENT、○ : GOOD、△ : AVERAGE、× : POOR)

IMAGE FORMING APPARATUS CONTROLLING THE RECYCLING OF TONER BASED ON PAPER QUALITY

CROSS REFERENCE

This Nonprovisional application claims priority under 35 U.S.C. §119(a) on Patent Application No. 2005-322544 filed in Japan on Nov. 7, 2005, the entire contents of which are hereby incorporated by reference.

BACKGROUND OF THE TECHNOLOGY

The present technology relates to an image forming apparatus that performs electrophotographic image forming such as a copier or a printer, and more particularly to an image forming apparatus having a toner recycling function for reusing toner collected from the surface of an image supporting body.

With an electrophotographic image forming process implemented in an image forming apparatus such as a copier or a printer, an electrostatic latent image formed on the surface of a photosensitive drum (image supporting body) is developed into a visual image (hereinafter, "toner image") by a powder developer (hereinafter, "toner") supplied from a developing device. This toner image is transferred to paper (including recording media such as OHP etc.) in a transfer process. At this time, part of the toner remains on the surface of the photosensitive drum and is not transferred to paper.

Because the photosensitive drum is used repeatedly in image forming process, leaving toner that remains on the surface of the photosensitive drum (residual toner) deteriorates image quality the next time image forming process is performed. The image forming apparatus thus eliminates and discards residual toner on the surface of the photosensitive drum using a cleaning device.

However, running costs rise due to increased wastage of toner as a result of residual toner being discarded. In view of this, there are conventional image forming apparatuses using a two-component developer composed of a toner and a carrier that have a so-called recycling mechanism whereby residual toner eliminated from the surface of the photosensitive drum by a cleaning device as shown in FIG. 1 is collected in a developing device and reused for suppressing toner wastage.

The image forming apparatus shown in FIG. 1 has a photosensitive drum 51, and further includes an image forming portion 50 that has a charger 52, a developing device 54, a transferer 55, a cleaning device 57, a neutralizer 58, and the like disposed in this order along the circumferential surface of the photosensitive drum 51. The image forming portion 50 also includes a recycling mechanism 59 that transports residual toner from the cleaning device 57 to the developing device 54. The cleaning device 57 includes a blade 57A that contacts the surface of the photosensitive drum 51, and scrapes off and collects residual toner adhering to the surface of the photosensitive drum 51, after the toner image has been transferred to paper at a transfer location between the photosensitive drum 51 and the transferer 55.

The recycling mechanism 59 has a screw conveyor mechanism, and transports residual toner collected in the cleaning device 57 as recycled toner to the inside of the developing device 54 at a prescribed timing.

To evenly maintain the toner density of images formed on paper in an electrophotographic image forming process that uses a two-component developer, sufficient toner necessary to visualize the electrostatic latent image needs to be held in the developing device.

For this reason, image forming apparatuses adopt a configuration in which the amount of toner held in the developing device is detected based on the detection signal (toner density) of a toner density sensor that uses a magnetic permeability sensor, for example, and toner is supplied to the developing device based on this detection result.

The magnetic permeability sensor detects the magnetic permeability of the two-component developer in the developing device. A change in the magnetic permeability indicates a change in the toner consumed from the two-component developer. The magnetic permeability of the toner is low, while the magnetic permeability of the carrier is high. Also, the amount of carrier hardly changes. Thus, the magnetic permeability of the two-component developer decreases the greater the amount of toner in the developing device.

However, in the case of a direct transfer method in which the toner image is transferred to the paper touching the surface of the photosensitive drum, paper dust (paper fibers, paper additives, etc.) adhering to the paper shifts to the surface of the photosensitive drum during the transfer. Paper dust, which has a low magnetic permeability, is thus eliminated by the cleaning device together with the residual toner, and gets mixed in the recycled toner, thereby affecting the precision at which toner density is detected by the toner density sensor.

This results in either too much or too little toner being supplied to the developing device, making it impossible to properly maintain image density. In particular, much of the paper dust once collected is continually transferred to paper and circulated around the developing device, the photosensitive drum and the recycling mechanism. Thus, when residual toner is continuously recycled by the recycling mechanism, the effect on the precision at which toner density is detected gradually increases with the gradual increase in the density of paper dust in the developing device.

In the developing process for visualizing an electrostatic latent image formed on the surface of the photosensitive drum, paper dust with toner adhered to the periphery thereof shifts from the developing device to the surface of the photosensitive drum together with the toner. As a result, in the transfer process for transferring a toner image formed on the surface of the photosensitive drum to paper, some of the paper dust with toner adhered to the periphery thereof shifts to the surface of the paper, while the rest remains on the surface of the photosensitive drum and is again collected by the cleaning device together with the residual toner. Further, when transferring the toner image to paper, some of the paper dust adhering to the paper also newly adheres to the surface of the photosensitive drum and is collected. Here, it is thought that the amount of paper dust gradually builds up because the amount of paper dust that attaches to the photosensitive drum from the paper is greater than the paper dust transferred together with the toner from the photosensitive drum to the paper.

Also, when paper dust with toner adhered to the periphery thereof adheres to the surface (white background) of paper in the transfer process, undesired dots are formed on the paper, reducing image quality.

In view of this, with an image forming apparatus disclosed in JP6-308828A, for example, for solving these problems, an oscillatable mesh paper dust trapping member is disposed arbitrarily on the collection path of the residual toner, and only reusable toner is separated out by eliminating paper dust included in the collected toner.

An image forming apparatus disclosed in JP H10-214011A includes a sorting roller charged to a negative potential which is a sorting means that makes use of differences in the amount of charge, and collects only adequate toner of a suitable particle size that is charged to an adequate positive charge from the surface of the photosensitive drum. Note that a cleaning portion collects the remaining inadequate toner.

Further, an image forming apparatus disclosed in JP 2005-3783A has a means for measuring the amount of impurities in residual toner on the toner recycling path, and selects whether to circulate the residual toner to the developing device or discard the residual toner according to the measurement result.

Note that the paper is broadly divided into medium and high quality, and that a recycled paper classification also exists depending on the manufacturing method. There is a process for removing a component called "lignin" included in tree fibers that is like pine resin at the stage of manufacturing pulp fibers, with lignin being removed from "high quality paper" but remaining in "medium quality paper" (plain paper). High quality paper is white paper such as copy paper and print paper, while medium quality paper is used in newspapers, magazines, and cardboard. Medium quality paper is of poor quality, and is almost never used for image forming in electrophotographic image forming apparatuses such as copiers or printers, which have strict requirements regarding paper quality.

In contrast, the use of recycled paper made from recycled high quality paper for image forming in electrophotographic image forming apparatuses has recently been increasing in consideration of the global environment. Recycled paper is a mixture of different paper fibers that is discolored with printing ink and whose fibers are unavoidably degraded through repeated use. For this reason, the quality of paper whose raw material is recycled pulp (recycled paper) drops in comparison to paper made with new raw materials from timber (virgin pulp). Thus, the amount of paper dust (mainly paper fibers) produced with recycled paper is much greater than high quality paper.

However, a configuration in which recycled toner is collected so as not to include paper dust as described above requires expensive apparatuses such as paper dust trapping members, sorting rollers, sensors for detecting the amount of paper dust such as paper dust in toner or masses of aggregate toner and the like, thereby giving rise to cost hikes.

SUMMARY OF THE TECHNOLOGY

An object of the present technology is to provide an image forming apparatus having a toner recycling mechanism that is able to maintain image quality by securing the amount of toner in a developing device while at the same time suppressing cost hikes with a simple structure.

The present technology includes an image supporting body, a developing device, a cleaning device, an input device, a recycling mechanism, and a controller. The image supporting body is for having a latent image based on image data formed on a surface thereof. The developing device applies a developer to the image supporting body to develop the latent image. The cleaning device eliminates developer remaining on the surface of the image supporting body, after a developer image formed by the developing has been transferred to paper. The input device receives a setting input related to a type of paper for use in image forming. The recycling mechanism transports the developer eliminated by the cleaning device to the developing device as recycled developer. The controller is configured to selectively operate the recycling mechanism based on the type of paper set by the input device.

BRIEF DESCRIPTION OF THE DRAWINGS

FIG. 6 shows experiment results for a case in which residual toner was always collected in a collecting tank as recycled toner.

FIG. 7 shows experiment results for a supply ratio of recycled toner to unused toner.

DETAILED DESCRIPTION OF THE TECHNOLOGY

An image forming apparatus according to preferred embodiments is described in detail below with reference to the drawings.

Figure 1:
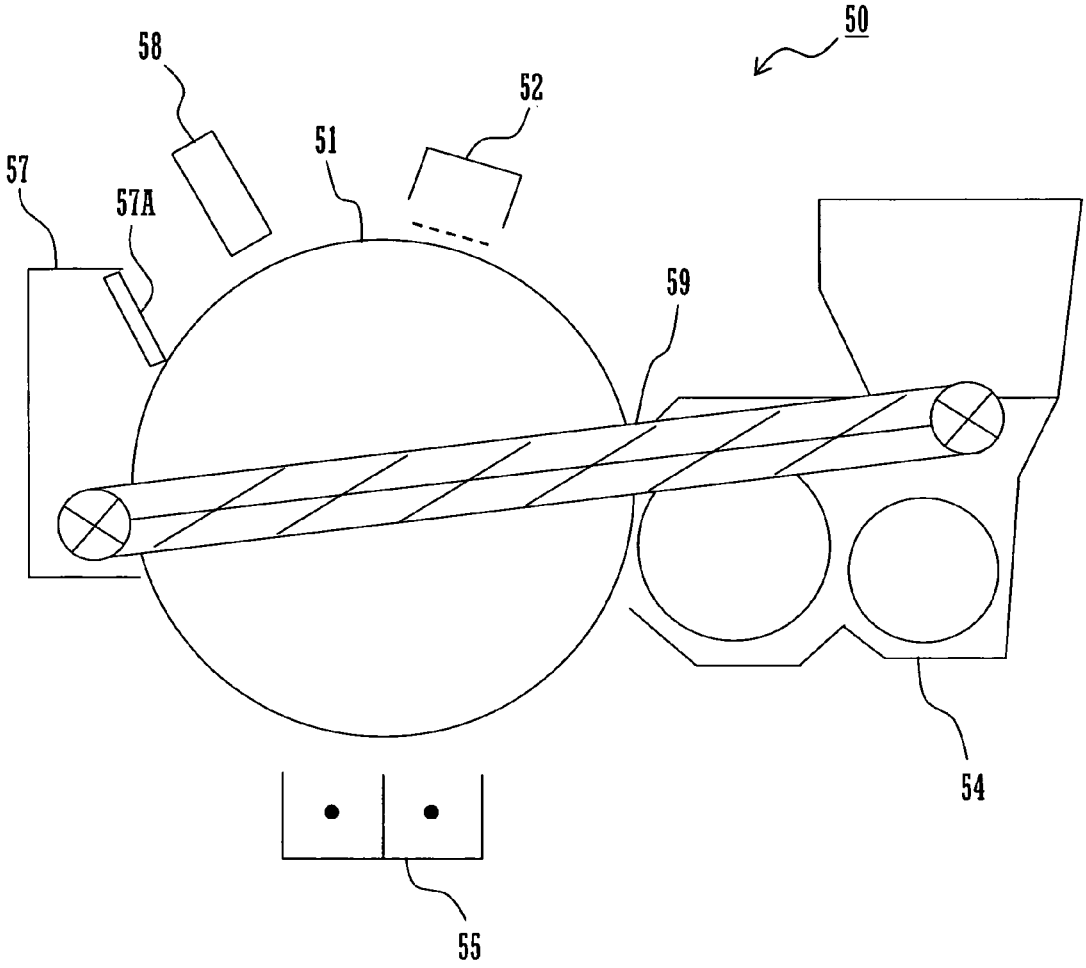
FIG. 1 is a front cross-sectional view showing a simple configuration of an image forming portion in a conventional image forming apparatus.
Figure 2:
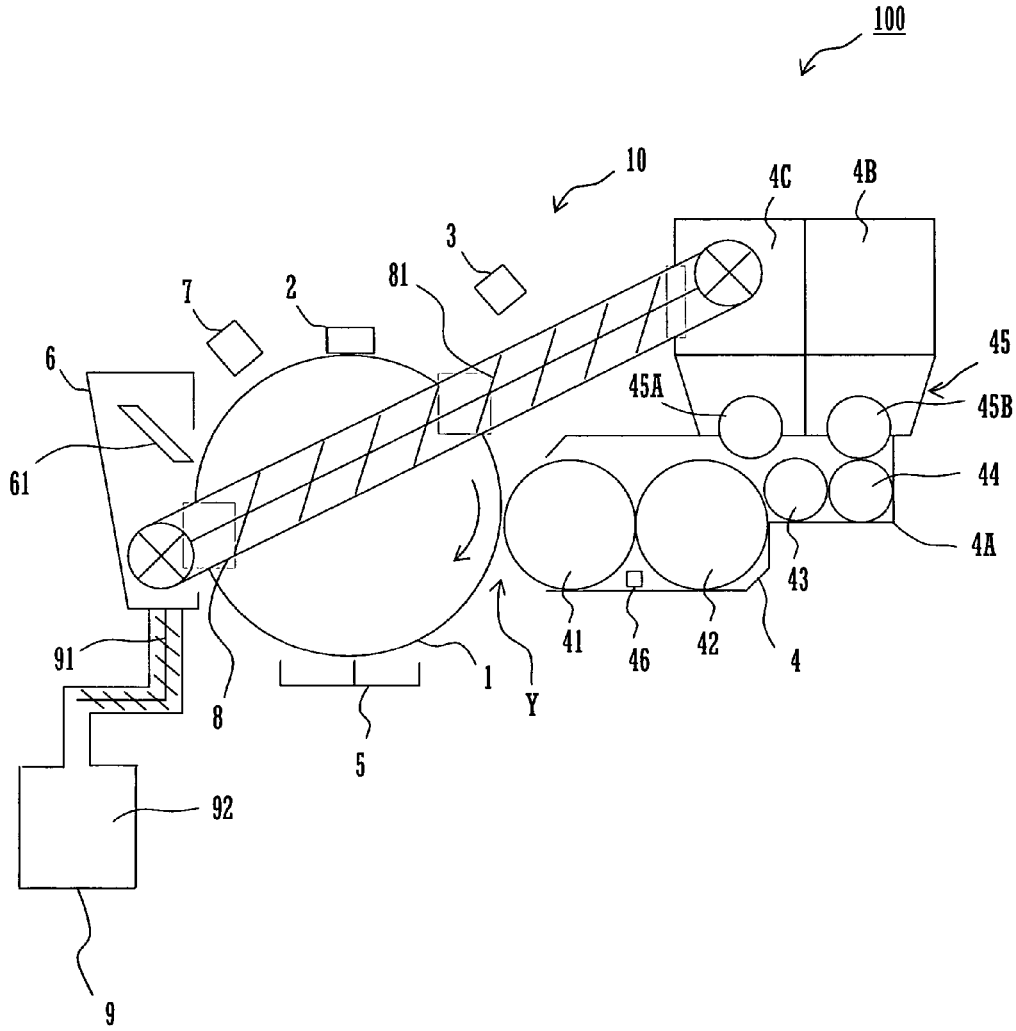
FIG. 2 is a front cross-sectional view showing a simple configuration of an image forming portion provided in an image forming apparatus.

FIG. 2 is a front cross-sectional view showing a simple configuration of an image forming portion provided in an image forming apparatus according to the embodiments. An image forming apparatus 100 includes an image forming portion 10 and the like, and forms images on paper based on image data. The image forming portion 10 has a photosensitive drum 1 that rotates at a predetermined speed, and is configured from a charger 2, a write unit (exposure unit) 3, a developing device 4, a transferer 5, a cleaning device 6, a neutralizer 7 and the like that are disposed in order around the photosensitive drum 1. The image forming portion 10 also includes a recycling mechanism 8 and a waste toner collecting mechanism 9.

The photosensitive drum 1, which equates to the image supporting body, includes a photoconductive layer on the surface thereof, and rotates at a constant speed in the direction of the arrow shown in FIG. 2 during image forming. Also, the photosensitive drum 1 supports the toner image at the surface thereof. The charger 2 imparts a unipolar charge uniformly to the circumferential surface of the photosensitive drum 1. The write unit 3 irradiates image light, which is laser light, for example, onto the surface of the photosensitive drum 1, based on image data supplied from a control portion described below, and forms an electrostatic latent image on the surface of the photosensitive drum 1 as a result of photoconductive action.

The developing device 4 supplies toner to the electrostatic latent image formed on the surface of the photosensitive drum 1, and visualizes (develops) the electrostatic latent image. The developing device 4 includes a developing roller 41 and agitator rollers 42 to 44 inside a developing tank 4A. The developing device 4 also includes a supply mechanism 45 on top of the developing tank 4A, a supply tank 4B, and a collecting tank 4C.

The developing tank 4A holds a toner and a carrier that constitute a two-component developer. The developing roller 41 uses rotation to transport toner attaching to the carrier adhered to the circumferential surface thereof to a developing area Y that faces the surface of the photosensitive drum 1. Toner in the developing area Y electrostatically attaches to the surface of the photosensitive drum 1.

The agitator rollers 42 to 44 transport toner supplied from the supply tank 4B and the collecting tank 4C to the developing roller 41 while agitating and mixing the toner with the carrier. At this time, the toner electrostatically attaches to the surface of the carrier with the toner charged to a prescribed charge. The carrier with toner electrostatically attached to the surface thereof attaches to the circumferential surface of the developing roller 41, forming a chain, as a result of the magnetic force of a magnetic pole internalized by the developing roller 41. The carrier is then transported to the developing area Y following the rotation of the developing roller 41. In the developing area Y, only the toner electrostatically attaches to the electrostatic latent image formed on the surface of the photosensitive drum 1. This results in a toner image being formed on the surface of the photosensitive drum 1.

The supply tank 4B, which equates to the unused toner supplier, is removable from the developing device 4, and holds unused toner. The collecting tank 4C, which equates to the recycled toner supplier, is removable from the developing device 4, and holds residual toner collected by the cleaning device 6 as recycled toner. The supply mechanism 45 is configured from supply rollers 45A, 45B and the like, and supplies toner from both the supply tank 4B and the collecting tank 4C to the developing tank 4A. The supply mechanism 45 is controlled using the control portion.

The developing device 4 includes a toner density sensor 46 on the bottom of the developing tank 4A between the developing roller 41 and the agitator roller 42. The toner density sensor 46 detects the toner density of the two-component developer in the developing tank 4A. A magnetic permeability sensor is used in the present embodiment as the toner density sensor 46. The magnetic permeability sensor detects the magnetic permeability of the two-component developer in the developing tank 4A. A change in the magnetic permeability indicates a change in the toner consumed out of the two-component developer. The magnetic permeability of the toner is low, while the magnetic permeability of the carrier is high. Also, the amount of carrier hardly changes. Thus, the magnetic permeability detected by the magnetic permeability sensor decreases the greater the amount of toner in the developing device.

The control portion judges that there is insufficient toner in the developing tank 4A when the magnetic permeability exceeds a prescribed value, and drives the supply mechanism 45 to supply toner.

The transferer 5 transfers the toner image supported by the surface of the photosensitive drum 1 at a transfer location between the photosensitive drum 1 and the transferer 5 to paper transported from a feeding portion (not shown) at a prescribed timing. Sheets on which toner images have been transferred are ejected into a discharge tray (not shown) via a fixing apparatus (not shown), and the like.

The cleaning device 6 includes a scraper member 61, and eliminates toner and the like remaining on the surface of the photosensitive drum 1 after the toner image has been transferred to paper. The scraper member 61 in the present embodiment uses a blade whose free end contacts the surface of the photosensitive drum 1 at a prescribed pressure, and scrapes off residual toner including residual material such as paper dust and the like adhered to the surface of the photosensitive drum 1 from paper. The residual toner scraped off the surface of the photosensitive drum 1 is initially stored in the cleaning device 6.

The neutralizer 7 eliminates charge remaining on the surface of the photosensitive drum 1 after the cleaning. The recycling mechanism 8, which connects the cleaning device 6 and the collecting tank 4C, is driven at a prescribed timing by the control portion, and transports residual toner stored within the cleaning device 6 to the collecting tank 4C as recycled toner. The recycling mechanism 8 of the present embodiment is configured by a screw conveyer mechanism that has a transport screw 81. The transport screw 81 rotates to transport residual toner inside the cleaning device 6 to the collecting tank 4C.

The waste toner collecting mechanism 9 in the present embodiment is configured by a screw conveyer mechanism that has a transport screw 91. The waste toner collecting mechanism 9 is driven at a prescribed timing by the control portion, and collects residual toner stored in the cleaning device 6 as waste toner. The waste toner collecting mechanism 9 also includes a waste toner collecting tank 92 for holding waste toner.

Figure 3:
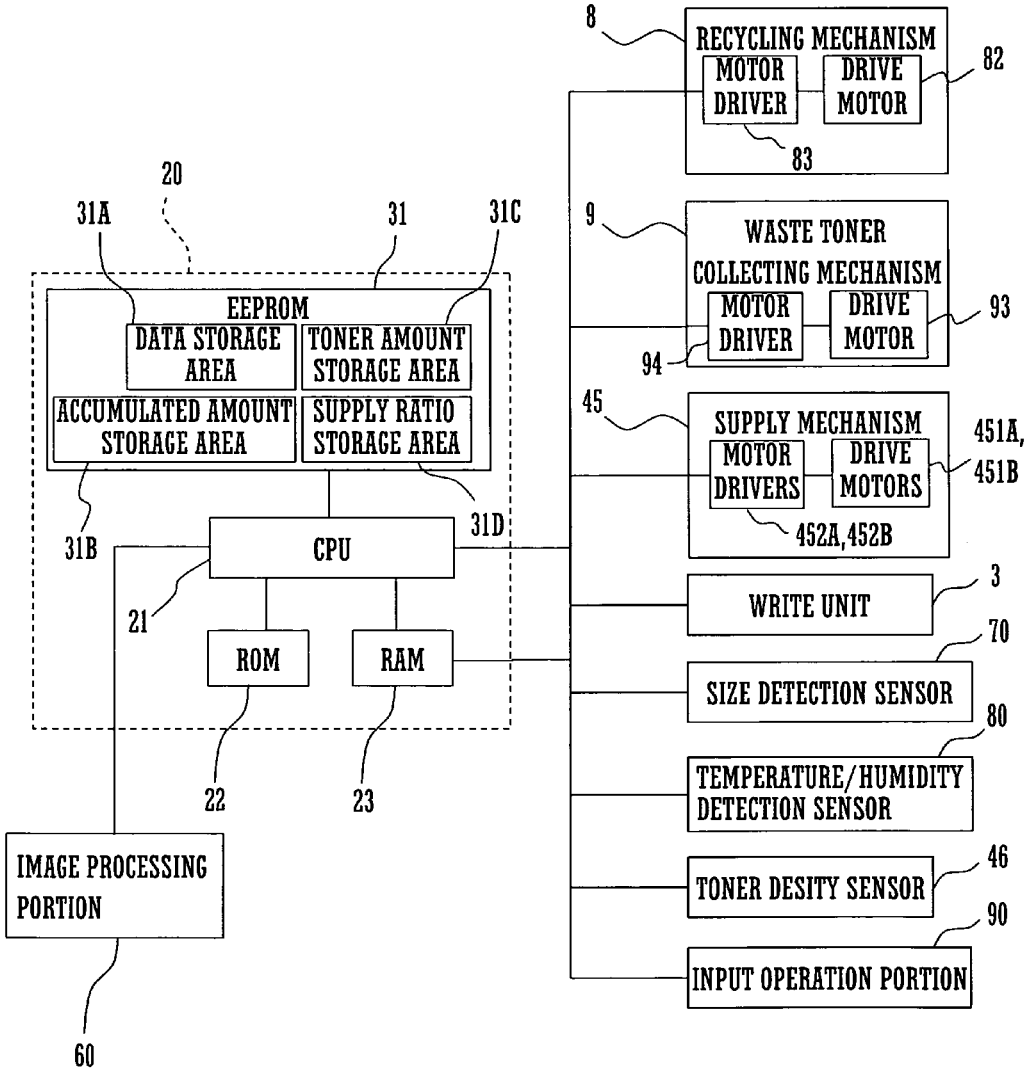
FIG. 3 is a block diagram showing a configuration of a control portion provided in the image forming apparatus.

FIG. 3 is a block diagram showing the configuration of a control portion 20. The image forming apparatus 100 includes the control portion 20, which controls the operation of the entire apparatus. The control portion 20, which equates to the controller, is configured from a ROM 22, a RAM 23, an EEPROM 31, and the like. A CPU 21 constituting the control portion 20 has connected thereto an image processing portion 60, the write unit 3, the recycling mechanism 6, the supply mechanism 45, the waste toner collecting mechanism 9, a size detection sensor 70, a temperature/humidity detection sensor 80, the toner density sensor 46, an input operation portion 90, and the like.

The CPU 21 performs the overall control of the entire apparatus as well as controlling the write unit 3 and the like, with reference to detection signals input from the sensors 46, 70 and like, in accordance with a program written in advance in the ROM 22.

The image processing portion 60 performs prescribed image processing on image data input from an external apparatus via an interface (not shown) or image data read from a document in a scanning portion (not shown), based on a control signal output from the CPU 21.

The recycling mechanism 8 includes a drive motor 82 that rotates the transport screw 81, and a motor driver 83. The CPU 21 drives the drive motor 82 via the motor driver 83 when residual toner collected in the cleaning device 6 is transported as recycled toner.

The supply mechanism 45 includes drive motors 451A and 451B that rotate the supply rollers 45A and 45B, and motor drivers 452A and 452B. The CPU 21 drives the drive motors 451A and 451B via the motor drivers 452A and 452B based on the set supply ratio.

The waste toner collecting mechanism 9 includes a drive motor 93 that rotates the transport screw 91, and a motor driver 94. The CPU 21 drives the drive motor 93 via the motor driver 94 when residual toner collected by the cleaning device 6 is collected (discarded) as waste toner.

The size detection sensor 70 detects the size of paper to be used in the image forming process, and inputs a detection signal to the CPU 21. The temperature/humidity detection sensor 80 detects the temperature and humidity in a vicinity of the image forming portion 10 during the image forming process, and inputs a detection signal to the CPU 21.

The toner density sensor 46 detects the toner density of the two-component developer held in the developing tank 4A, and inputs a detection signal to the CPU 21.

The input operation portion 90, which equates to the input device, has an LCD screen, and receives setting inputs related to the copy sheet number, paper type, or the like. A user, serviceperson or the like selects one of a plurality of prerecorded selection options displayed on the LCD screen for each setting item such as paper type, and performs an operation to decide on (set) the selected option.

The EEPROM 31 is configured from a data storage area 31A, an accumulated amount storage area 31B, a toner amount storage area 31C, a supply ratio storage area 31D, and the like. The data storage area 31A stores data such as the set paper type or size. The accumulated amount storage area 31B, which equates to the third storage portion, stores the accumulated amount of recycled toner. The toner amount storage area 31C stores the relation between an aggregate gradation value and a toner usage amount, and the relation between the toner usage amount, a transfer efficiency $\eta$, and a recycled toner (residual toner) amount. The supply ratio storage area 31D, which equates to the second storage portion, stores the relation between the accumulated amount of recycled toner and a supply ratio. The supply ratio is a ratio of the supply amount of unused toner to the supply amount of recycled toner to the developing tank 4A.

Figure 4:
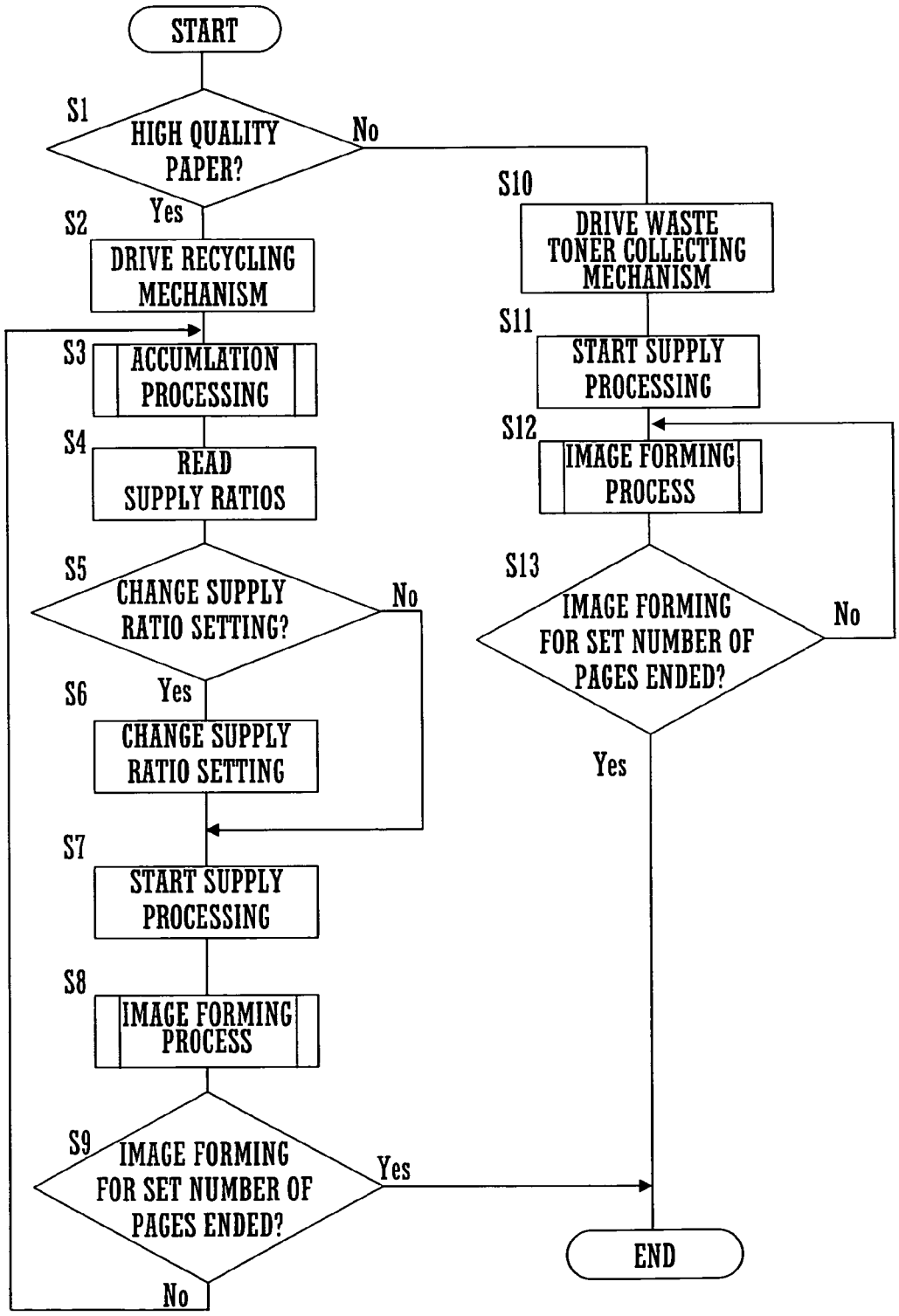
FIG. 4 is a flowchart showing a processing procedure when image forming is performed in the image forming apparatus.

FIG. 4 is a flowchart showing a processing procedure for when image forming is performed. When the user performs an input to start image forming by operating the input operation portion 90, the CPU 21 judges whether the type of paper set at the time of the user input to start image forming is a specific type that produces little paper dust (S1). The CPU 21 judges whether to transport residual toner to the collecting tank 4C as recycled toner, depending on whether the specific paper type that produces little paper dust is set. The specific paper type that produces little paper dust is high quality paper, for example. This is because the amount of paper dust that adheres to the surface of the photosensitive drum 1 with high quality paper is small in comparison to other paper. In the present embodiment, the CPU 21 judges at S1 whether the paper type is high quality paper.

Note that the CPU 21 may be configured to judge at S1 whether the amount of paper dust is small in comparison to other paper, based on the quality and size of the paper for use in image forming. Even with high quality paper, there is a lot of paper dust with large-sized sheets.

If judged at S1 that the set paper type is high quality paper, the CPU 21 drives the drive motor 82 provided in the recycling mechanism 8 (S2). This results in the transport screw 81 rotating and residual toner collected by the cleaning device 6 being transported to the collecting tank 4C as recycled toner.

Next, the CPU 21 performs accumulation processing to count the accumulated amount of recycled toner (S3). The accumulation processing involves accumulating the amount of recycled toner produced for each image forming process, and storing the accumulated amount in the accumulated amount storage area 31B of the EEPROM 31. This processing is described in detail below.

The CPU 21 then reads the currently set supply ratio from the data storage area 31A of the EEPROM 31, and reads the supply ratio that depends on the accumulated amount of recycled toner from the supply ratio storage area 31D of the EEPROM 31 (S4). Next, the CPU 21 judges whether to change the currently set supply ratio setting by comparing both the read supply ratios (S5).

If it is judged at S5 not to change the supply ratio, the processing moves to S7. On the other hand, if it is judged at S5 to change the supply ratio, the CPU 21 stores the supply ratio corresponding to the accumulated amount of recycled toner read from the supply ratio storage area 31D in the data storage area 31A as the set value (S6). Consequently, the control portion 20, which includes the CPU 21, also equates to the recycled amount accumulating portion and the supply ratio setting portion.

It is sufficient that the relation between the accumulated amount of recycled toner and the supply ratio is such that the supplied amount of recycled toner decreases as the accumulated amount of recycled toner increases.

The CPU 21 then starts the supply processing (S7). The supply processing involves supplying toner to the developing tank 4A with reference to the detection signal output by the toner density sensor 46. When toner is supplied, the CPU 21 changes the rotation speed ratio of the supply rollers 45A and 45B by driving the drive motors 451A and 451B provided in the supply mechanism 45 according to the set supply ratio. Because the drive motors 451A and 451B are set to equivalent drive times, toner of an amount that depends on the supply ratio is supplied from the supply tank 4B and the collecting tank 4C.

Next, the CPU 21 starts the image forming process (S8). The image forming process is known processing that spans from the supply of paper, though the transferring and fixing of a toner image by the image forming portion, to the discharge of paper into the discharge tray. The CPU 21 then judges whether image forming is complete for the requested number of sheets set at the time of the user input to start image forming (S9), and ends all processing if the image forming is judged to have ended. If the CPU 21 judges at S9 that image forming for the requested number of sheets is not complete, the processing returns to S3.

On the other hand, if judged at S1 that the set type of paper is other than high quality paper (e.g., recycled paper), the CPU 21 drives the drive motor 93 provided in the waste toner collecting mechanism 9 (S10). This results in the transport screw 91 rotating and residual toner collected by the cleaning device 6 being collected in the waste toner collecting tank 92 as waste toner.

Next, the CPU 21 starts the supply processing (S11). The supply processing at S11, which differs from the supply processing at S7, involves the supply of only unused toner from the supply tank 4B. This is because residual toner is not collected in the collecting tank 4C as recycled toner in the image forming.

The CPU 21 then executes the image forming process similarly to S8 (S12). Next, the CPU 21 judges whether image forming is complete for the requested number of sheets set at the time of the user input to start image forming (S13), and ends all processing if the image forming is judged to have ended. If the CPU 21 judges at S13 that image forming for the requested number of sheets is not complete, the processing returns to S12.

Note that in the present embodiment, a plurality of feed trays (not shown) for holding different types (qualities) of paper are provided in the feeding portion, and paper held in the set feed tray is transported to the image forming portion 10, one sheet at a time. Consequently, although the user in the present embodiment sets the paper type directly by operating the input operation portion 90, the type of paper may be judged via the setting of the feed tray from which paper is to be supplied, for example.

Specifically, the relation between the plurality of feed trays and the type of paper held in the feed trays input in advance by the user operating the input operation portion 90 is prestored in an area of part of the EEPROM 31. The input operation portion 90 receives a setting input related to a feed tray from the user at the time of the input to start image forming, and reads the type of paper held in the set feed tray from the EEPROM 31. If the manual tray is set, however, toner is not recycled owing to the difficulty in identifying the type of paper stored in the manual tray.

The setting of the feed tray is not limited to an input from the user, and may be set by the CPU 21 or the like. For example, an image forming condition such as the document size or the image forming magnification factor is input by the user via the input operation portion 90 at the time of the input to start image forming. The control portion 20 selects (sets) one appropriate feed tray from among the plurality of feed trays based on the image forming condition. The CPU 21 reads the type of paper held in the set feed tray from the EEPROM 31.

Consequently, the EEPROM 31 equates to the first storage portion, and the input operation portion 90 equates to the feed tray type input device. Also, the control portion 20, which includes the CPU 21, equates to the tray setting portion.

Figure 5:
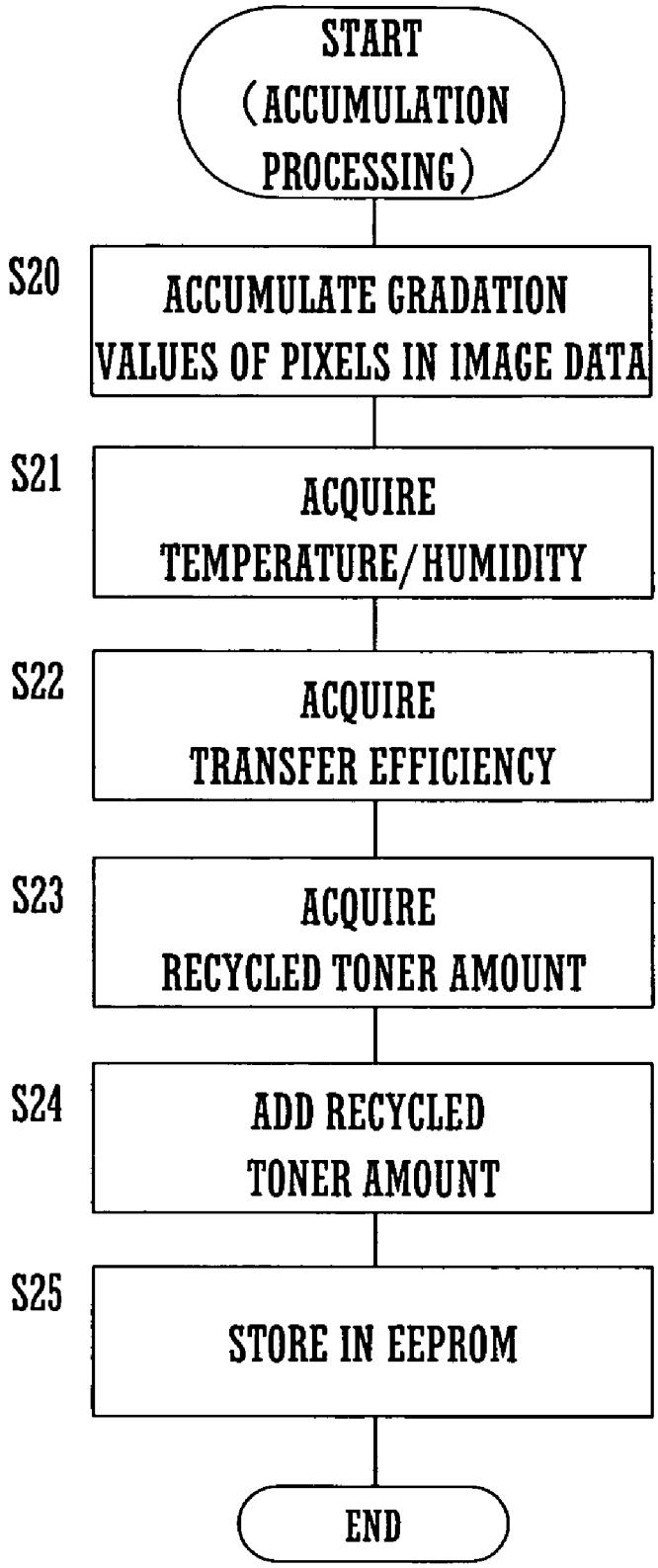
FIG. 5 is a flowchart showing a procedure for performing accumulation processing.

FIG. 5 is a flowchart showing a procedure for performing accumulation processing for counting the accumulated amount of recycled toner, executed at S3 shown in FIG. 4. The CPU 21 firstly causes the image processing portion 60 to detect the gradation value of each pixel in image data for use in image forming per sheet, and to further count the aggregate gradation value of the image data by accumulating the gradation values for all the pixels (S20). For example, the CPU 21 causes the image processing portion 60 to count the aggregate gradation value of pixels for one piece of image data immediately prior to image forming (e.g., prior to output to the write unit 3) in the case of a multi-value (color) image forming apparatus, and to count the aggregate number of black pixels for one piece of image data in the case of a binary (monochrome) image forming apparatus.

Next, the CPU 21 acquires the detection signal of the temperature/humidity detection sensor 80 (S21), and determines the transfer efficiency $\eta$ based on the temperature and humidity around the image forming portion 10, based on the acquired detection signal (S22). For example, the CPU 21 reads the transfer efficiency $\eta$ that depends on temperature and humidity, based on the relation between temperature/humidity and the transfer efficiency $\eta$ prestored in the toner amount storage area 31C of the EEPROM 31.

The CPU 21 then determines the recycled toner amount produced when image forming is performed on one sheet of paper (S23). Specifically, the CPU 21 reads the toner usage amount corresponding to the aggregate gradation value of the image data from the toner amount storage area 31C of the EEPROM 31, and reads the recycled toner amount corresponding to this toner usage amount and transfer efficiency $\eta$ from the toner amount storage area 31C. Note that the toner usage amount is the amount of toner needed to form a toner image.

Next, the CPU 21 adds the determined recycled toner amount (S24), and stores the result in the accumulated amount storage area 31B (S25). Specifically, the CPU 21 adds the recycled toner amount to the read accumulated amount of recycled toner stored in the accumulated amount storage area 31B of the EEPROM 31, and again stores the result in the accumulated amount storage area 31B.

Here, the toner usage amount and the transfer efficiency $\eta$ are used to determine the amount of recycled toner because the transfer efficiency $\eta$ of toner from the surface of the photosensitive drum 1 to paper changes according to temperature and humidity during the transfer process to transfer a toner image to paper. Since the amount of residual toner that remains without being transferred from the surface of the photosensitive drum 1 to paper during the transfer process changes with this change in the transfer efficiency $\eta$, the recycled toner amount also changes.

Note that although the accumulated amount of recycled toner in the present embodiment is counted by adding the recycled toner amount detected based on the transfer efficiency $\eta$ and the like, this technology is not particularly limited to this. For example, a sensor that detects weight may be disposed in the cleaning device 6, and the amount of residual toner collected by the cleaning device 6 for one image-formed sheet may be added as the recycled toner amount.

Experiment results for the case in which residual toner is always collected in the collecting tank 4C as recycled toner in the image forming apparatus 100 according to the present embodiment are shown in FIG. 6. FIG. 6 shows the result of evaluating the characteristics of images formed on paper after performing image forming on 20K sheets (20,000 sheets) using only high quality paper and only recycled paper under conditions in which a prescribed size of paper is used, and unused toner and recycled toner are supplied to the developing tank 4A at a 30% supply ratio of unused toner to recycled toner (the weight ratio of recycled toner to unused toner is 7:3). The image characteristics are evaluated by visual examination based on the number of undesired dots on the paper and the image density. As a result, it is revealed that undesired dots occurred frequently with recycled paper, making it unfit (unsuitable) for use in toner recycling.

This is because the adhered amount of paper dust is greater with the recycled paper in comparison to the high quality paper, which means that the amount of paper dust included in the residual toner collected by the cleaning device 6 is also greater.

With the high quality paper there is a drop only in image density.

Experiment results for the supply ratio of unused toner to recycled toner are shown in FIG. 7. This figure shows the result of evaluating the image density for image forming performed using only a prescribed number of sheets of high quality paper of a prescribed size, under conditions in which unused toner and recycled toner are supplied to the developing tank 4A at three different supply ratios of recycled toner of 30%, 25% and 20%.

The evaluation of image density is performed by visual examination, similarly to the experiment shown in FIG. 6. As a result, it is revealed that the drop in image density is marked for 20K sheets at the largest supply ratio of recycled toner of 30%, making it necessary to change the supply ratio of recycled toner prior to image forming on 20K sheets of paper. Consequently, it is revealed that a drop in image density can be prevented while at the same time effectively using recycled toner, by appropriately changing (lowering) the supply ratio of recycled toner as the number of image-formed sheets increases. That is, the supply ratio of recycled toner needs to be changed (lowered) as the amount of recycled toner increases.

For example, the initial value of the supply ratio of recycled toner in the initial toner supply processing is set to 30% as shown in FIG. 7, and the supply ratio of recycled toner is appropriately reduced as the accumulated amount of recycled toner increases.

As described above, in the image forming apparatus 100 according to the present embodiment, it is possible to reuse residual toner having little paper dust with a simple configuration by judging whether to collect residual toner as recycled toner based on the type of paper. This enables an increase in the amount of paper dust mixed in toner held in the developing tank 4A through usage to be prevented while at the same time suppressing cost hikes, which thereby makes it possible to suppress a drop in image density.

Also, since not much paper dust is mixed in the developing device, it is possible to prevent paper dust forming part of the toner image, and to maintain image quality.

Further, by changing the supply ratio according to the accumulated amount of recycled toner, it is possible to suitably prevent toner shortages in the developing tank 4A as seen from the above experiment results, and to suppress a drop in image density.

In the present embodiment, the supply ratio is set (determined) according to the accumulated number of image-formed sheets, instead of using the accumulated amount of recycled toner in setting the supply ratio. The accumulated number of sheets is stored in the accumulated amount storage area 31B of the EEPROM 31, and the relation between the accumulated number of sheets and the supply ratio is stored in the supply ratio storage area 31D of the EEPROM 31. Consequently, the accumulated amount storage area 31B equates to the fifth storage portion, and the supply ratio storage area 31D equates to the fourth storage portion. The remaining configuration is similar to the first embodiment.

Figure 8:
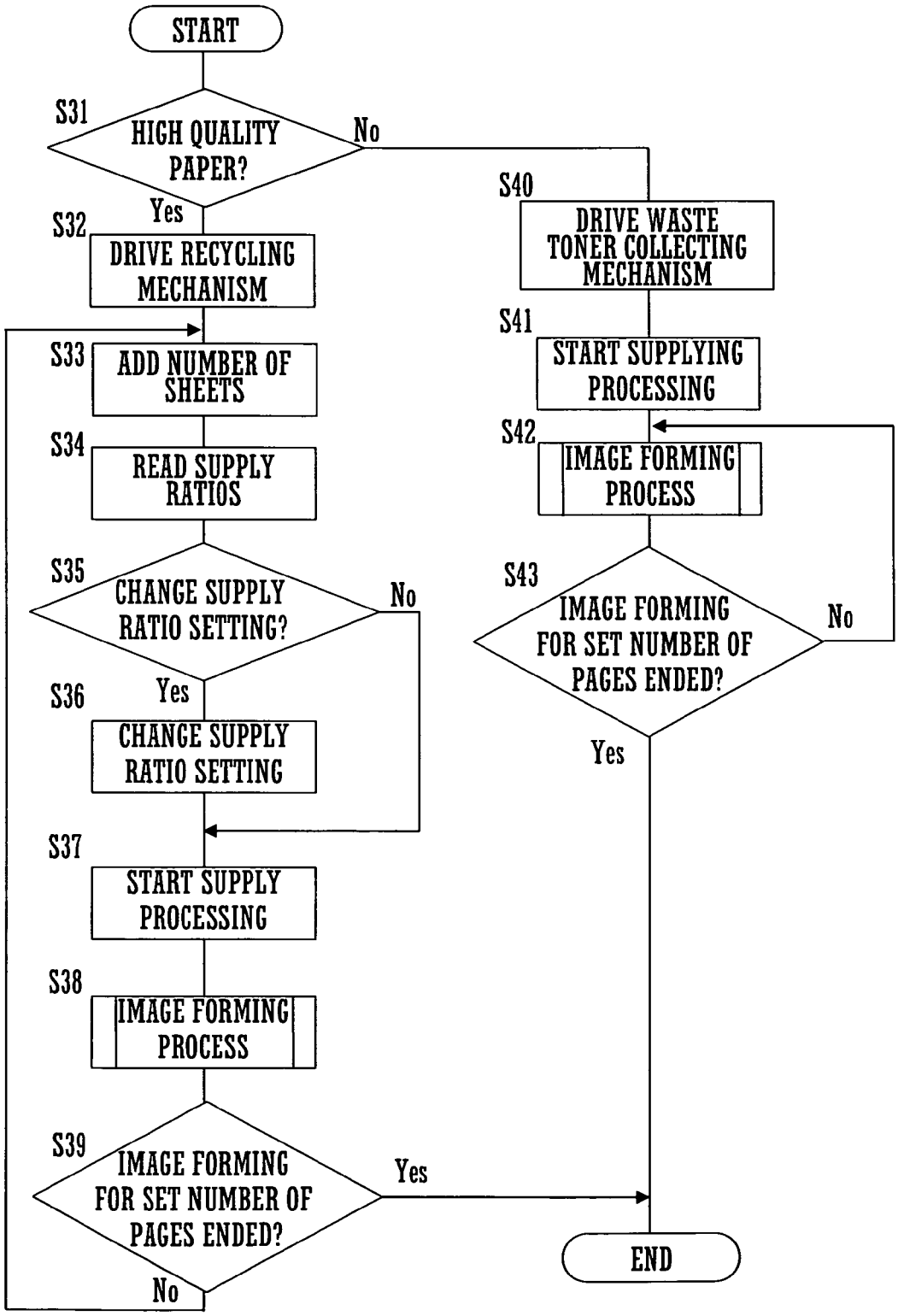
FIG. 8 is a flowchart showing a processing procedure when image forming is performed in the image forming portion of the image forming apparatus.

FIG. 8 is a flowchart showing the processing procedure for when image forming is performed. Note that a description of the processing of S31, S32, and S36 to S43 shown in FIG. 8, being similar to the processing of S1, S2, and S6 to S13 shown in FIG. 4, has been omitted.

After the user input via the input operation portion 90 to start image forming, the CPU 21 counts the accumulated number of sheets for image forming after executing S32, when it is judged at S31 that the type of paper is a specific type having little paper dust (high quality paper in the present embodiment), and stores the accumulated number of sheets in the accumulated amount storage area 31B of the EEPROM 31 (S33).

For example, the CPU 21 converts the size of the image data for image forming (size of paper suitable for image forming) to a prescribed paper size (e.g., A4 size), adds the obtained number of sheets to the accumulated number of sheets read from the accumulated amount storage area 31B, and again stores the result in the accumulated amount storage area 31B. Consequently, the control portion 20, which includes the CPU 21, also equates to the sheet number accumulating portion.

The CPU 21 then reads the currently set supply ratio from the data storage area 31A of the EEPROM 31, and the supply ratio that depends on the accumulated number of sheets from the supply ratio storage area 31D of the EEPROM 31 (S34). Next, the CPU 21 judges whether to change the setting of the current supply ratio by comparing both the read supply ratios (S35).

If it is judged at S35 not to change the supply ratio, the processing moves to S37. On the other hand, if it is judged at S35 to change the supply ratio, the CPU 21 stores the supply ratio corresponding to the accumulated number of sheets read from the supply ratio storage area 31D in the data storage area 31A as the set value (S36).

It is sufficient that the relation between the accumulated number of sheets and the supply ratio is such that the supplied amount of recycled toner decreases as the accumulated number of sheets increases. For example, the initial value of the supply ratio of recycled toner in the initial toner supply processing is 30% as shown in FIG. 7, and the supply ratio is set to 25% when the accumulated number of sheets is 15K, and to 20% when 20K.

This enables effects similar to the first embodiment to be achieved.

In the present embodiment, the supply ratio is set according to the accumulated number of rotations of the photosensitive drum 1 when image forming is performed, instead of using the accumulated amount of recycled toner in setting the supply ratio. The accumulated number of rotations of the photosensitive drum 1 is stored in the accumulated amount storage area 31B of the EEPROM 31, and the relation between the accumulated number of rotations of the photosensitive drum 1 and the supply ratio is stored in the supply ratio storage area 31D of the EEPROM 31.

Consequently, the accumulated amount storage area 31B equates to the seventh storage portion, and the supply ratio storage area 31D equates to the sixth storage portion. The remaining configuration is similar to the first embodiment.

Figure 9:
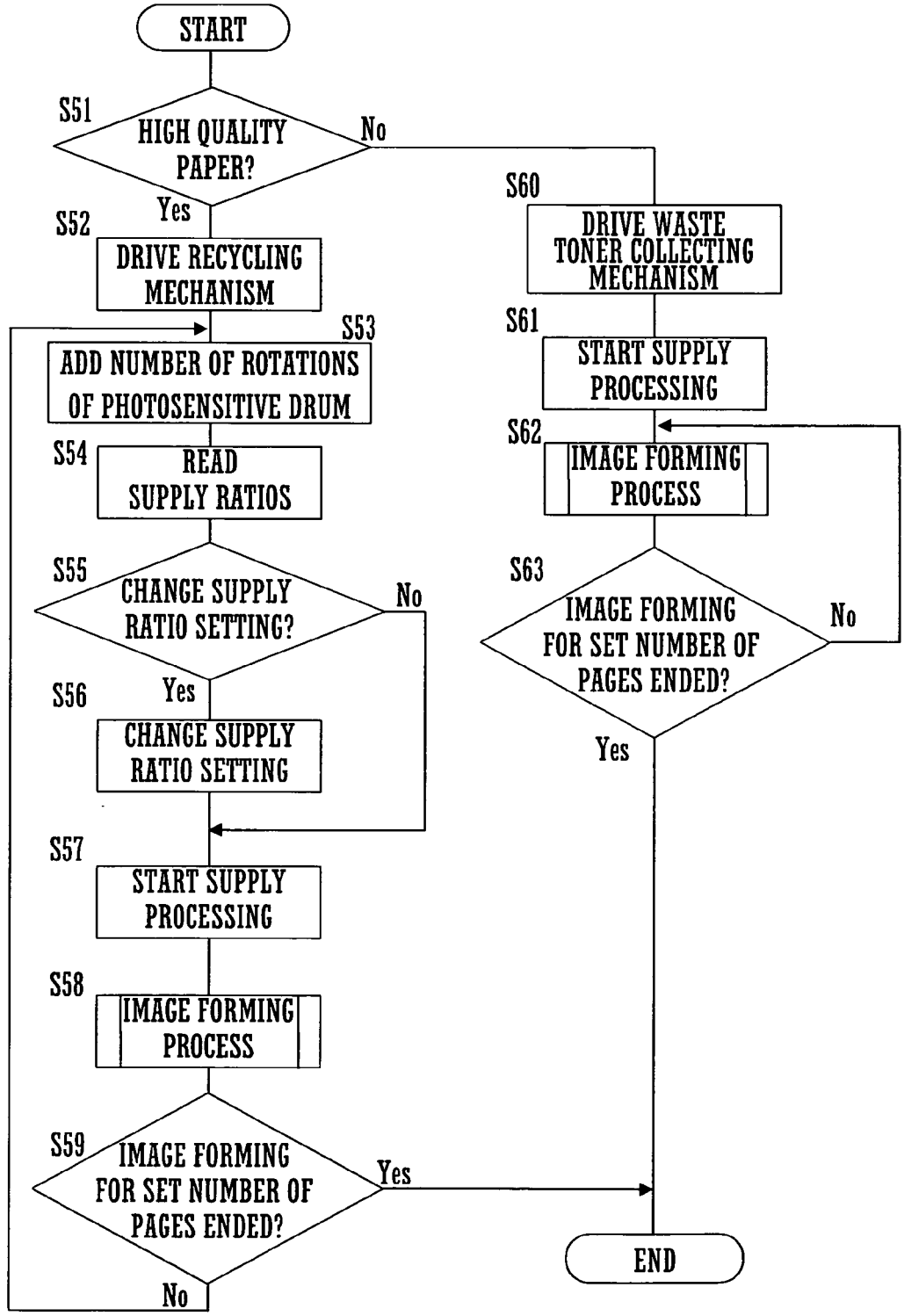
FIG. 9 is a flowchart showing a processing procedure when image forming is performed in the image forming portion of the image forming apparatus.

FIG. 9 is a flowchart showing the processing procedure for when image forming is performed. Note that a description of the processing of S51, S52, and S56 to S63 shown in FIG. 9, being similar to the processing of S1, S2, and S6 to S13 shown in FIG. 4, has been omitted.

After the user input via the input operation portion 90 to start image forming, the CPU 21 counts the accumulated number of rotations of the photosensitive drum 1 when transferring a toner image to paper after executing S52, when it is judged at S51 that the type of paper is a specific type having little paper dust (high quality paper in the present embodiment), and stores the accumulated number of rotations of the photosensitive drum in the accumulated amount storage area 31B of the EEPROM 31 (S53).

For example, the CPU 21 counts the number of rotations of the photosensitive drum 1 when transferring a toner image to paper, based on the size of the image data for image forming (size in the vertical scanning direction) and the circumferential length of the photosensitive drum 1, adds the counted number of rotations to the accumulated number of rotations of the photosensitive drum 1 read from the accumulated amount storage area 31B, and again stores the result in the accumulated amount storage area 31B. Consequently, the control portion 20, which includes the CPU 21, also equates to the rotation number accumulating portion.

The CPU 21 then reads the currently set supply ratio from the data storage area 31A of the EEPROM 31, and the supply ratio that depends on the currently accumulated number of rotations of the photosensitive drum 1 from the supply ratio storage area 31D of the EEPROM 31 (S54). Next, the CPU 21 judges whether to change the setting of the current supply ratio by comparing both the read supply ratios (S55).

If it is judged at S55 not to change the supply ratio, the processing moves to S57. On the other hand, if it is judged at S55 to change the supply ratio, the CPU 21 stores the supply ratio corresponding to the currently accumulated number of rotations read from the supply ratio storage area 31D in the data storage area 31A as the set value (S56). It is sufficient that the relation between the accumulated number of rotations of the photosensitive drum 1 and the supply ratio is such that the supplied amount of recycled toner decreases as the accumulated number of rotations of the photosensitive drum 1 increases.

Since the accumulated amount of recycled toner also increases as the accumulated number of rotations of the photosensitive drum 1 increases, similar effects to the first embodiment can be achieved. Also, it is possible to judge the characteristics of the residual toner (recycled toner), coupled also with the mechanical stress and temporal change of the recycled toner, when residual toner is eliminated from the surface of the photosensitive drum 1, in addition to the amount of paper dust mixed therein, and to more accurately set the supply ratio.

Note that the accumulated rotation time of the photosensitive drum 1 may be used instead of the accumulated number of rotations. For example, the time from when transportation of a sheet held sandwiched by registration rollers (not shown) is started in sync with the transfer timing of the toner image, until the time at which the back end of the sheet reaches the fixing apparatus (not shown) after the toner image has been transferred is set as the rotation time. This rotation time is prestored in the data storage area 31A of the EEPROM 31 for each paper size. The CPU 21 reads the rotation time corresponding to the paper size for use in image forming at S53 shown in FIG. 9, adds the read rotation time to the accumulated rotation time of the photosensitive drum 1 read from the accumulated amount storage area 31B, and again stores the result in the accumulated amount storage area 31B.

Consequently, the control portion 20, which includes the CPU 21, also equates to the rotation time accumulating portion.

The numerical values in the accumulated amount storage area 31B of the EEPROM 31 that relate to the accumulated amount of recycled toner, the accumulated number of sheets, and the accumulated number of rotations or accumulated rotation time of the photosensitive drum 1 described in the first to third embodiments are cleared by the CPU 21 when the two-component developer including the carrier is replaced in the developing device 4, or when the unit of the image forming portion 10 including the developing device 4 is replaced, for example.

Note that although the first to third embodiments were described using a monochrome image forming apparatus 100, the present technology may be applied in image forming portions for various colors in a tandem color image forming apparatus.

Because the residual toner of different colors on the transfer belt are mixed when in full-color mode, for example, in an intermediate transfer image forming apparatus configured to transfer a toner image to paper after transferring toner images of various colors to the transfer belt in layers, a configuration may be adopted in which this technology is applied only when in monochrome mode, and residual toner is only collected as recycled toner in the image forming portion for forming black toner images. A configuration may also be adopted in which mixed color residual toner collected when in full-color mode is only collected as recycled toner in the image forming portion for forming black toner images. Image quality is relatively unproblematic in the case of black, even with mixed colors.

Finally, the description of the foregoing embodiment is in all respects illustrative and not limiting. The scope of this technology is indicated by the scope of the claims rather than by the foregoing embodiment. Further, all changes that come within the meaning and range of equivalency of the claims are intended to be embraced in the scope of this technology.

What is claimed is:

1. An image forming apparatus comprising:

an image supporting body for having a latent image based on image data formed on a surface thereof;

a developing device that applies a developer to the image supporting body to develop the latent image;

a cleaning device that eliminates developer remaining on the surface of the image supporting body, after a developer image formed by the developing device has been transferred to paper;

an input device that receives a setting input related to a type of paper for use in image forming, wherein the setting input received by the input device indicates a quality of the paper for use in image forming;

a recycling mechanism that transports the developer eliminated by the cleaning device to the developing device as recycled developer;

a controller configured to selectively operate the recycling mechanism based on the type of paper set by the input device a supply ratio setting portion configured to set a supply ratio, which is a ratio of a supply amount of unused developer to a supply amount of recycled developer for when developer is supplied to the developing device, wherein the developing device includes:

a recycled supplier for holding the recycled developer transported by the recycling mechanism;

an unused supplier for holding unused developer; and a supply mechanism that supplies developer to a developing tank of the developing device from the recycled supplier and the unused supplier, and wherein the supply mechanism is driven based on the supply ratio set by the supply ratio setting portion;

a first storage portion for storing a relation between a total accumulated amount of the recycled developer that has been transported to the developing device and the supply ratio;

a second storage portion for storing the total accumulated amount of recycled developer that has been transported to the developing device; and a recycled amount accumulating portion configured to detect an amount of recycled developer produced for each image forming process, and to add the detected amount of recycled developer to the total accumulated amount of recycled developer stored in the second storage portion, wherein the supply ratio setting portion is configured to read the supply ratio that depends on the total accumulated amount of recycled developer accumulated by the recycled amount accumulating portion from the first storage portion.

2. The image forming apparatus according to claim 1, wherein the type of paper includes at least different qualities of paper, and the controller is configured to operate the recycling apparatus when the paper quality set by the input device is a specific quality that produces little paper dust.

3. The image forming apparatus according to claim 1, further comprising:

a plurality of feed trays that each hold a different type of paper;

a feed tray type input device that receives a setting input related to a relation between the plurality of feed trays and the type of paper held in the feed trays; and a third storage portion for storing the relation between the plurality of feed trays and the quality of paper held in the feed trays set by the feed tray type input device, wherein the input device receives a setting input for selecting a feed tray from the plurality of feed trays as the setting input related to the type of paper, and the controller is configured to read the quality of paper held in the feed tray set by the input device from the third storage portion, and to operate the recycling mechanism when the quality of paper held in the feed tray is the specific quality that produces little paper dust.

4. The image forming apparatus according to claim 3, wherein the controller is configured not to drive the recycling mechanism when the feed tray set by the input device or the feed tray set by the tray setting portion is a manual feed tray.

5. The image forming apparatus according to claim 1, further comprising:

a plurality of feed trays that each hold a different type of paper;

a feed tray type input device that receives a setting input related to a relation between the plurality of feed trays and the type of paper held in the feed trays; and a third storage portion for storing the relation between the plurality of feed trays and the quality of paper held in the feed trays set by the feed tray type input device, wherein the input device receives a setting input related to an image forming condition as the setting input related to the type of paper, the image forming apparatus further comprises a tray setting portion that sets one of the plurality of feed trays based on the image forming condition set by the input device, and the controller is configured to read the quality of paper held in the feed tray set by the tray setting portion from the third storage portion, and to operate the recycling mechanism when the quality of paper held in the feed tray is the specific quality that produces little paper dust.

6. The image forming apparatus according to claim 5, wherein the controller is configured not to drive the recycling mechanism when the feed tray set by the input device or the feed tray set by the tray setting portion is a manual feed tray.

7. The image forming apparatus according to claim 1, further comprising:

a third storage portion for storing a relation between an accumulated number of image-formed sheets and the supply ratio;

a fourth storage portion for storing the accumulated number of image-formed sheets;

a sheet number accumulating portion configured to add the number of sheets for each image forming process to the accumulated number of sheets stored in the fourth storage portion, wherein the supply ratio setting portion is configured to read the supply ratio that depends on the accumulated number of sheets accumulated by the sheet number accumulating portion from the third storage portion.

8. The image forming apparatus according to claim 1, further comprising:

a third storage portion for storing a relation between an accumulated number of rotations of the image supporting body and the supply ratio;

a fourth storage portion for storing the accumulated number of rotations of the image supporting body; and a rotation number accumulating portion configured to detect rotation time of the image supporting body for each image forming process, and add the detected number of rotations to the accumulated number of rotations of the image supporting body stored in the fourth storage portion, wherein the supply ratio setting portion is configured to read the supply ratio that depends on the accumulated number of rotations of the image supporting body accumulated by the rotation number accumulating portion from the third storage portion.

9. The image forming apparatus according to claim 1, further comprising:

an third storage portion for storing a relation between an accumulated rotation time of the image supporting body and the supply ratio;

a fourth storage portion for storing the accumulated rotation time of the image supporting body; and a rotation time accumulating portion configured to detect the rotation time of the image supporting body for each image forming process, and add the detected rotation time to the accumulated rotation time of the image supporting body stored in the fourth storage portion, wherein the supply ratio setting portion is configured to read the supply ratio that depends on the accumulated rotation time of the image supporting body accumulated by the rotation time accumulating portion from the third storage portion.

* * * * *